United States Patent [19]

Sato

[11] Patent Number: 4,904,142

[45] Date of Patent: Feb. 27, 1990

[54] APPARATUS FOR INSERTING ELONGATED HEAVY ARTICLES INTO STOWAGE CELLS ON SHIPS

[75] Inventor: Kenji Sato, Osaka, Japan

[73] Assignee: Hitachi Zosen Corporation, Osaka, Japan

[21] Appl. No.: 318,201

[22] Filed: Mar. 3, 1989

[30] Foreign Application Priority Data

Mar. 8, 1988 [JP] Japan ..... 63-54687

[51] Int. Cl.[4] ..... B66C 19/00

[52] U.S. Cl. ..... 414/142.6; 212/211; 212/220; 212/187; 414/141.4; 414/22.55

[58] Field of Search ..... 414/141.4, 142.6, 140.3, 414/141.5, 141.3, 540, 591, 542, 560, 561, 22.54, 22.55; 212/211, 218, 220, 261, 187, 190

[56] References Cited

U.S. PATENT DOCUMENTS

| | | | |
|---|---|---|---|
| 3,244,297 | 4/1966 | Kinkopf | 414/142.6 |
| 4,106,641 | 8/1978 | Campbell et al. | 414/142.6 |
| 4,702,661 | 10/1987 | Bisiach | 212/220 |

FOREIGN PATENT DOCUMENTS

| | | | |
|---|---|---|---|
| 7801497 | 5/1979 | Netherlands | 414/142.6 |

*Primary Examiner*—Robert J. Spar
*Assistant Examiner*—James T. Eller, Jr.
*Attorney, Agent, or Firm*—Armstrong, Nikaido, Marmelstein, Kubovcik & Murray

[57] ABSTRACT

An apparatus for use on a ship having in its hull a stowage with a multiplicity of cells in a latticework arrangement and each having an opening in a deck for individually stowing elongated heavy articles in a vertical position. The apparatus is adapted to insert the articles into the respective stowage cells and comprises a lower structure having a pair of opposed carriages guidable respectively on a pair of rails extending in parallel to each other and disposed on the deck outwardly of the respective opposite sides of the stowage, and an upper structure supported by the lower structure pivotally movably upward and downward and having a horizontal beam extending transversely of the ship, and a slider slidably mounted on the beam. A boom connected to the slider has a pair of guide arms for guiding and holding the article and is positionable horizontally along the direction of travel of the carriage and also vertically by the pivotal movement of the upper structure. The boom has a lift device for suspending the article.

8 Claims, 8 Drawing Sheets

APPARATUS FOR INSERTING ELONGATED HEAVY ARTICLES INTO STOWAGE CELLS ON SHIPS

BACKGROUND OF THE INVENTION

The present invention relates to an apparatus for use on ships for inserting elongated heavy articles into stowage cells, and more particularly to an apparatus for use on a ship having stowage cells provided in a latticework arrangement within its hull and each having an opening on the deck for housing a multiplicity of elongated heavy articles, such as surface-to-air missiles, in a vertical position, the apparatus being adapted to insert the articles into the respective cells one by one.

The so-called vertical launch system has predominantly been in use for launching surface-to-air missiles. With this system, missiles, each held in a canister, are stowed in a vertical position in a hull. More specifically, a stowage including a multiplicity of cells is provided within the hull for stowing the respective missiles in a vertical position. Each of the cells has an opening in the deck which is usually held closed with a watertight pressure-resistant door.

The system is adapted to launch many missiles at a time, and the stowage needs to be replenished with a corresponding number of missiles. After the missile has been launched, the canister remains in the cell, and the canister is removed before the cell is replenished.

With the vertical launch system, the replenishment is accomplished usually in the following manner. Each missile is supplied as placed in a canister to the ship from another ship or the like by being guided along a wire rope extending from one ship to the other as disposed thereabove. The canister has at each end thereof a shock absorber for ensuring safety and is provided at its midportion with a fork pocket for a fork lift.

When the canistered missile is delivered, the shock absorbers and the fork pocket are removed from the canister. The canister is held in suspension by crane at one point using a vertical strongback and placed into a specified cell of the stowage.

The opening of the stowage cell is provided with a cell guide for guiding the lower end of the canistered missile, whereas the canistered missile, supported in suspension, having a length of about 6 m and weighing about 2 tons, is extremely difficult to fit into the cell guide on the ship which is pitching or rolling since it is difficult to hold the missile at rest even with ten workers. Further even when the lower end of the canister is placed in the cell guide, the canistered missile swings owing to the rocking of the ship when it is raised to a vertical position in suspension.

Thus the work for inserting the missile into the stowage cell on board is difficult because of the rock of the ship, requires a prolonged period of time and is very hazardous to the worker. Moreover, it becomes impossible to carry out the stowing work when the wave height increases to about 5 m.

SUMMARY OF THE INVENTION

The invention provides an apparatus for inserting elongated heavy articles into a stowage in a ship with high safety within a shortened time. For use on a ship having in its hull a stowage with a multiplicity of cells in a latticework arrangement and each having an opening in a deck for individually stowing elongated heavy articles in a vertical position, the present invention provides an apparatus for inserting the articles into the respective stowage cells, the apparatus comprising a lower structure having a pair of opposed carriages guidable respectively on a pair of rails extending in parallel to each other and disposed on the deck outwardly of the respective opposite sides of the stowage, an upper structure supported by the lower structure pivotally movably upward and downward and having a horizontal beam extending transversely of the ship and a slider slidably mounted on the horizontal beam, a boom connected to the slider and having a pair of guide arms for guiding and holding the article, the boom being positionable horizontally along the direction of travel of the carriages and also vertically by the pivotal movement of the upper structure, and lift means provided on the boom for suspending the article, whereby each of the articles can be moved to the specified one of the cells, raised to the vertical position and lowered for insertion into the cell as mechanically guided with good stability. Accordingly, the elongated heavy articles can be inserted into the respective stowage cells with safety within a short period of time despite rocking of the ship.

The invention will be described in greater detail with reference to the accompanying drawings.

BRIEF DESCRIPTION OF THE DRAWINGS

FIG. 10 is a schematic plan view showing the apparatus while it is out of use;

FIG. 11 is a schematic plan view showing the apparatus during use with the canistered missile thereby held; and FIG. 12 is a schematic plan view showing the same with the canistered missile raised to a vertical position.

DESCRIPTION OF THE PREFERRED EMBODIMENT

Figure 1:
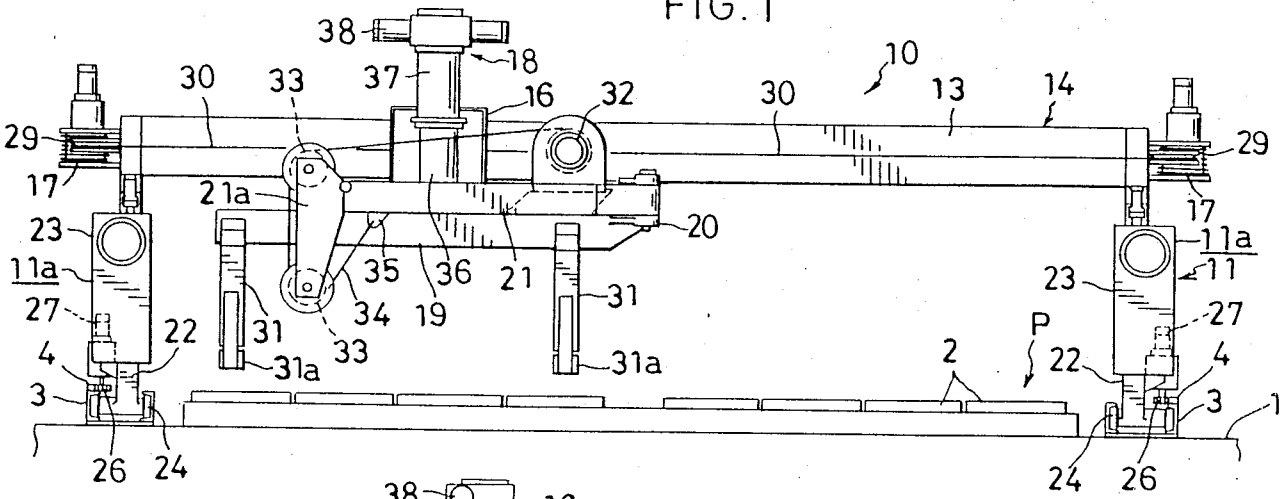
FIG. 1 is a front view showing an apparatus embodying the invention for inserting missiles into a stowage while the apparatus is not in use.
Figure 2:
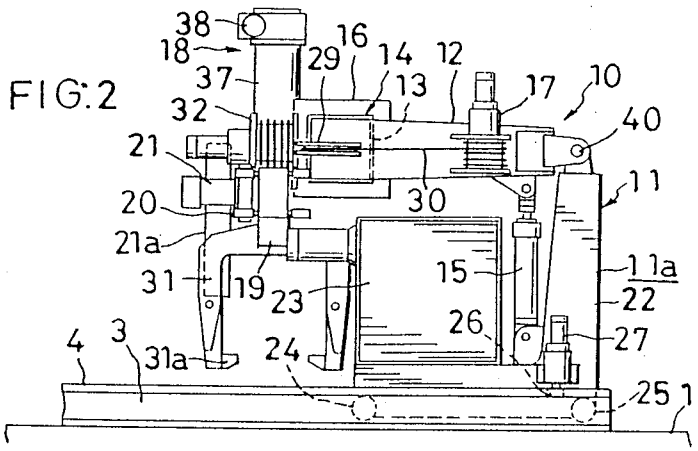
FIG. 2 is a side elevation showing the apparatus of FIG. 1.

With reference to FIGS. 1 to 3 and FIG. 10, a stowage P formed within a hull includes cells in a latticework arrangement and each having an opening in a deck 1 for individually stowing a multiplicity of missiles M as accommodated in canisters. The opening of each cell of the stowage P is provided with a cell guide (not shown) and is usually closed with a watertight pressure-resistant protective door 2. A pair of opposed rails 3 extend longitudinally of the hull and are disposed on the deck 1 outwardly of the respective opposite sides of the stowage P. Each of the rails 3 comprises a pair of channels 3a spaced apart transversely of the hull with their inner sides opposed to each other. A rack 4 secured to one of the channels 3a extends over the entire length thereof. To the rear of the stowage P, an apparatus 10 is mounted on the rails 3 for inserting each missile M into one of the stowage cells.

The missile inserting apparatus 10 comprises a lower structure 11 including a pair of opposed carriages 11a guidable by the respective rails 3, an upper structure 14 including a pair of arms 12 each pivoted at its rear end to the top of the carriage 11a by a transverse horizontal pin 40, and a horizontal beam 13 extending between and secured to the front ends of the arms 12, a pair of opposed hydraulic cylinders 15 for pivotally moving the upper structure 14 upward to an upright position and downward to a horizontal position, a slider 16 slidably mounted on the horizontal beam 13, a pair of winches 17 for moving the slider 16, a first boom 19 extending transversely of the hull and connected to the slider 16 by a hydraulic actuator 18 swivelably in a horizontal plane, and a second boom 21 connected to one end of the first boom 19 by a hinge pin joint 20 so as to be in parallel to the boom 19 when seen from above and positioned at a higher level than the boom 19.

Figure 9:
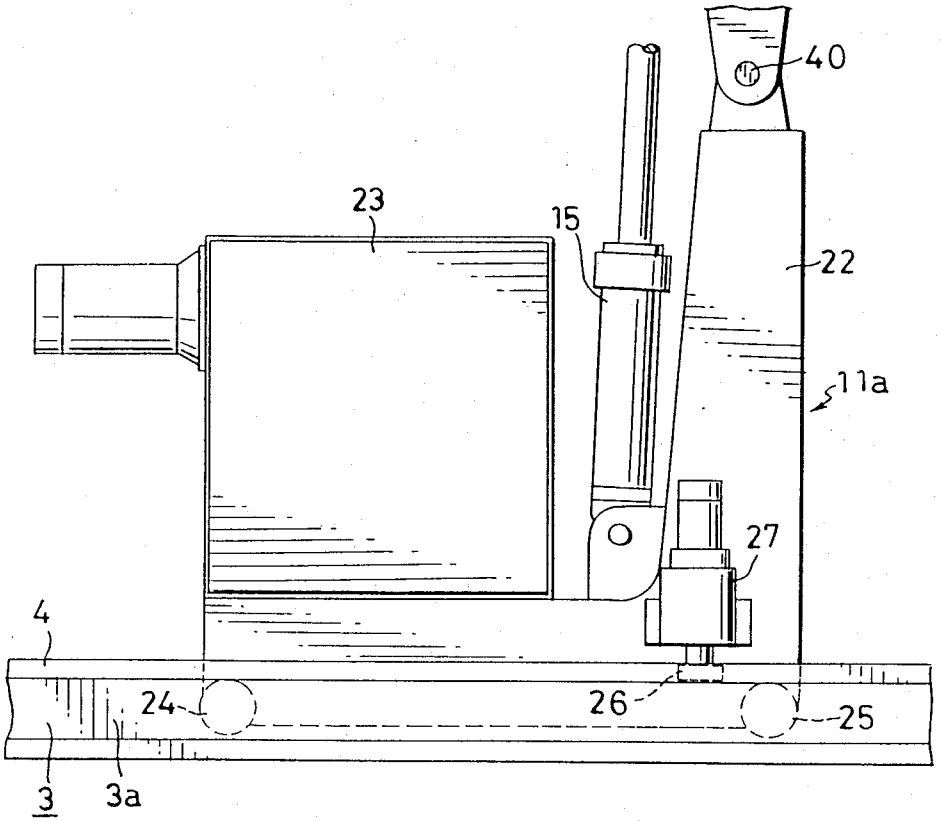
FIG. 9 is a side elevation showing the carriage of FIG. 8.
Figure 8:
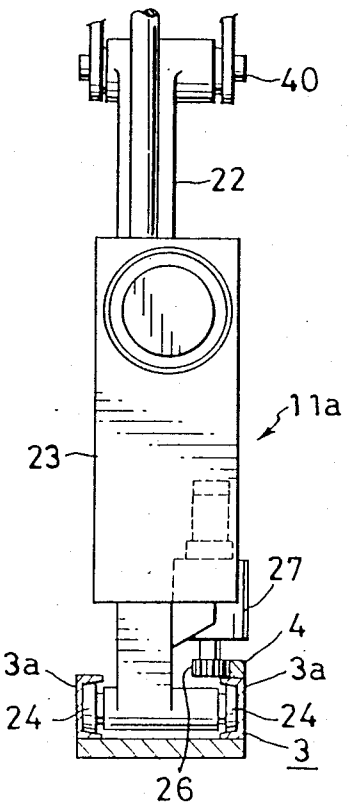
FIG. 8 is an enlarged front view showing one of a pair of carriages.

As seen on an enlarged scale in FIGS. 8 and 9, each carriage 11a comprises a carriage frame 22 having the arm 12 pivoted to its upper end and L-shaped when seen from one side, an electric-hydraulic power unit 23 fixedly mounted on the lower horizontal portion of the frame 22, a pair of front wheels 24 and a pair of rear wheels 25 rollable on the lower horizontal portions of the pair of channels 3a of the rail 3, and drive means 27 for rotating a pinion 26 meshing with the rack 4 to drive the carriage 11a. The drive means 27 comprises a hydraulic motor having a brake, and a reduction gear. The horizontal beam 13 is in the form of a pipe having a square cross section and has slidably fitted therearound the slider 16 in the form of a horizontal tube of square cross section. The slider 16 has a plurality of rollers (not shown) rollable on the outer surface of the horizontal beam 13. The arms 12 have their rear ends interconnected by a reinforcing pipe 28.

Figure 6:
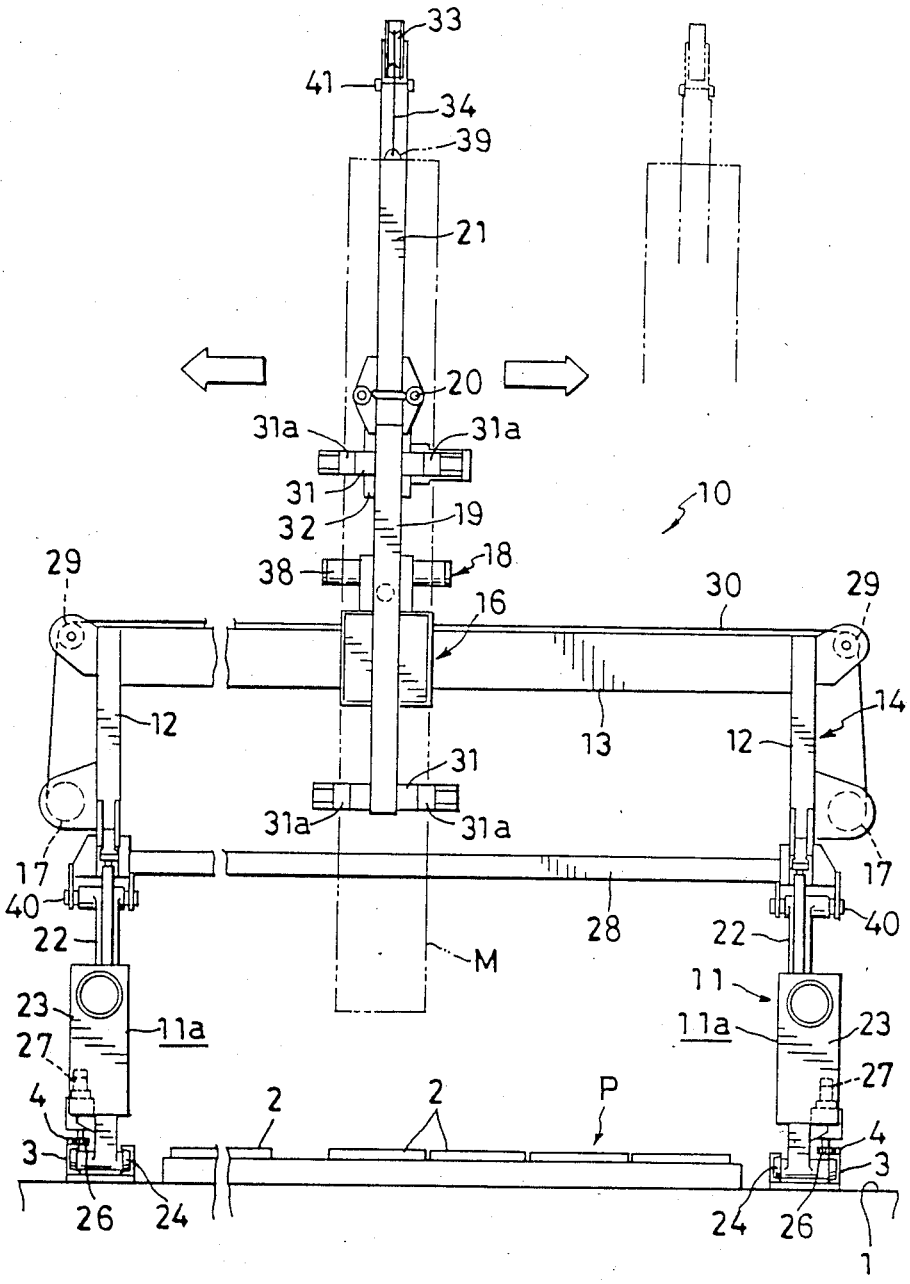
FIG. 6 is a front view showing the apparatus in use with the canistered missile raised to a vertical position.
Figure 7:
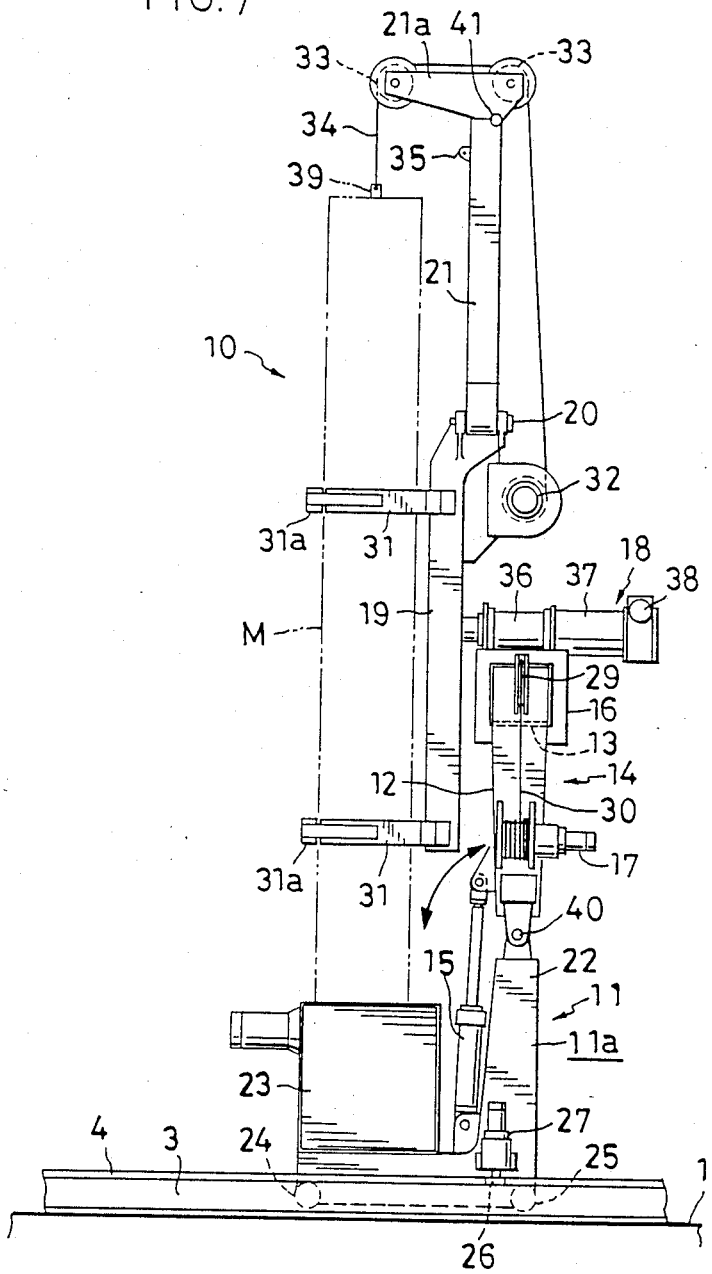
FIG. 7 is a side elevation showing the apparatus in the state of FIG. 6.

The hydraulic cylinder 15 is pivoted at its base end approximately to the inner corner portion of the L-shaped carriage frame 22 and has its piston rod forward end pivoted to the support arm 12 at a portion thereof close to its rear end. The upper structure 14 is movable by the pair of hydraulic cylinders 15 between a boom fallen position wherein the arms 12 are horizontal and a boom raised position wherein the arms 12 are vertical as seen in FIGS. 6 and 7.

Each of the arms 12 is provided with a slider moving winch 17 outwardly of its rear end. This winch 17 is driven by drive means comprising a brake-equipped hydraulic motor and a reduction gear. Each arm 12 has a pulley 29 on the outer side of its front end. A wire 30 extending from the winch 17 on each arm 12 is reeved around the pulley 29 on the arm 12 and secured to the corresponding one of opposite sides of the slider 16, whereby the slider 16 is slidable along the horizontal beam 13 either rightward or leftward.

A pair of guide arms 31, each in an inverted U-shape, are attached to the respective ends of the first boom 19 to hold the canistered missile M and also serve as guides for preventing the missile M from swinging when the missile M is to be inserted into the specified cell of the stowage P. Each guide arm 31 has a pair of openable pawls 31a at its respective ends. A missile suspending winch 32 is mounted on a lengthwise intermediate portion of the first boom 19. The winch 32 is driven by drive means comprising a brake-equipped hydraulic motor and a reduction gear.

Figure 3:
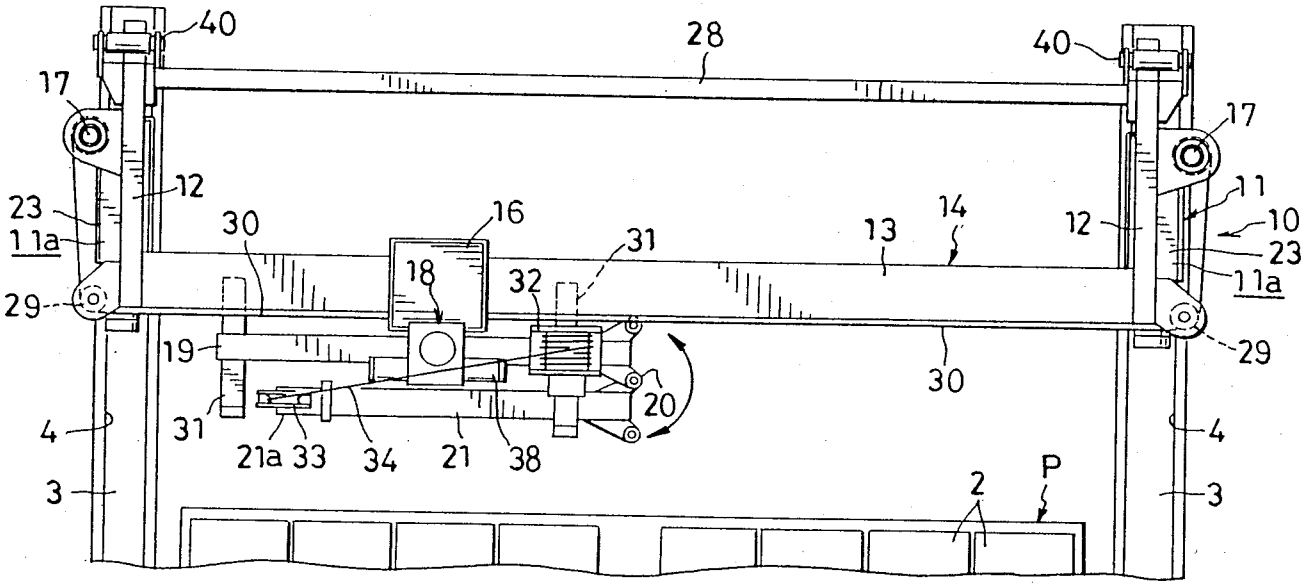
FIG. 3 is a plan view of the apparatus of FIG. 1.

A pulley holder 21a having a pair of upper and lower pulleys 33 is pivoted to the forward end of the second boom 21 by a horizontal pin 41 and is movable through about 60 degrees. A wire 34 extending from the missile suspending winch 32 is reeved around the two pulleys 33 and removably attached at its forward end to a wire retainer 35 provided on the lower side of the second boom 21. As seen in FIG. 3, the first and second booms 19, 21 are usually folded over each other at the hinge pin joint 20 and are coextensive as joined together along a direction perpendicular to the direction of travel of the carriages 11a.

The hydraulic actuator 18 comprises a hydraulic cylinder 36 attached to the front side of the slider 16 as oriented downward and having a hollow rod, a rotary shaft (not shown) rotatably inserted through the hollow rod and secured at its forward end to the first boom 19, and a hydraulic swivel motor 38 having an output shaft connected to the rotary shaft by a slide coupling 37. The first boom 19 can be swiveled through about 100 degrees about the rotary shaft by the hydraulic swivel motor 38 of the hydraulic actuator 18 and is movable about 20 cm by the hydraulic cylinder 36 of the actuator 18 in the direction of advance or retraction of the rod thereof.

Figure 10:
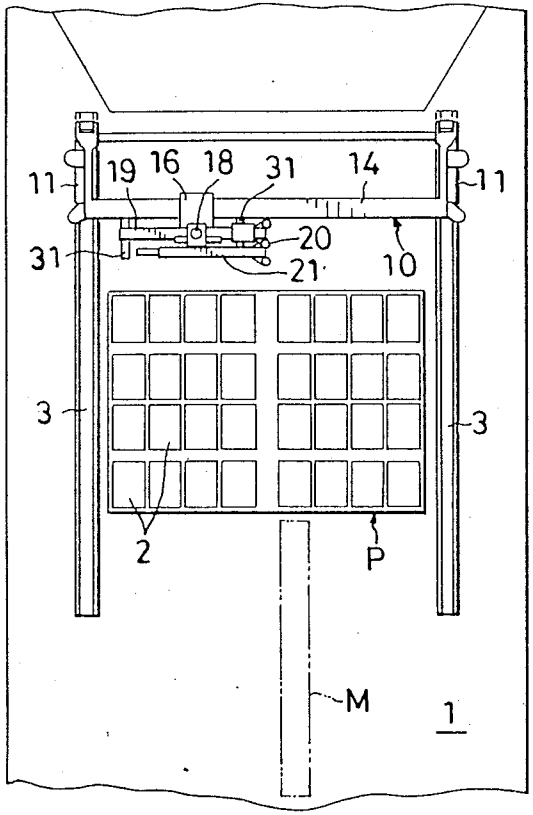
Figure 12:
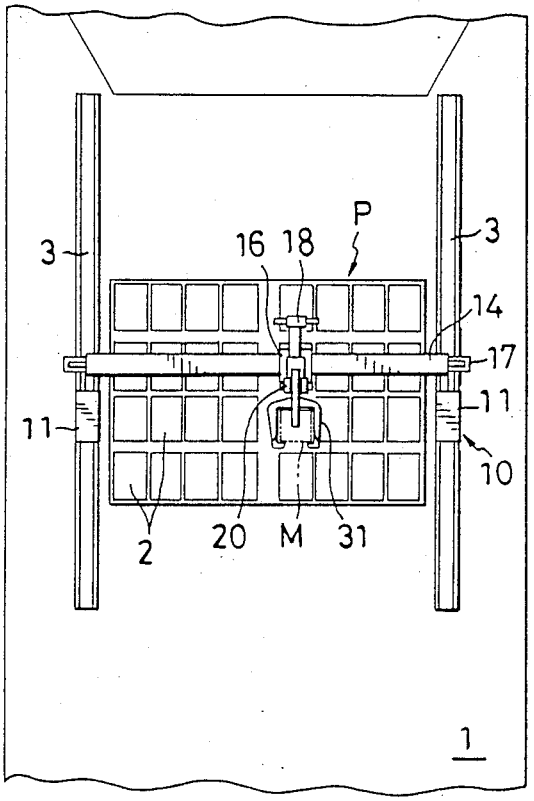

A missile M is supplied as placed in a canister to the ship from another ship by being guided by a wire extending between the two ships and positioned thereabove. The canistered missile M is provided with a shock absorber (not shown) at each end thereof and with a fork pocket (not shown) at its midportion. The canistered missile M supplied onto the deck 1 is placed as oriented longitudinally of the shape in a predetermined location in front of the stowage P as seen in FIG. 10.

Before the canistered missile M in the location is placed into the desired cell of the stowage P, the shock absorbers and the fork pocket are removed from the canistered missile M first, and a vertically suspending adapter 39 is then attached to the upper end of the canistered missile M.

Figure 5:
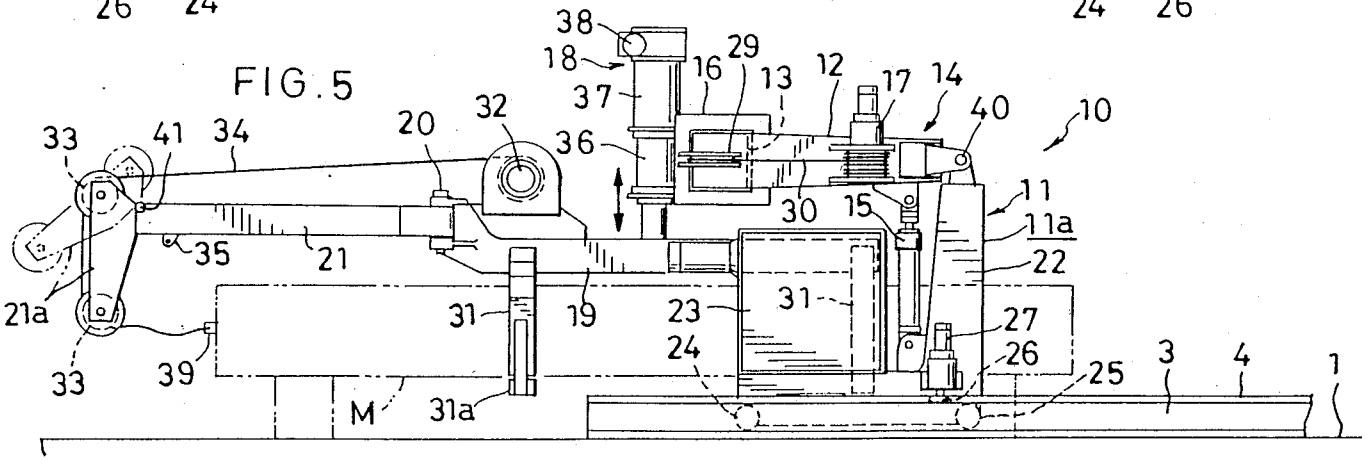
FIG. 5 is a side elevation showing the apparatus in the state of FIG. 4.

The first boom 19 and the second boom 21 of the missile inserting apparatus 10 are so reconnected by the hinge pin joint 20 as to be in alignment with each other. The two booms 19, 21 connected together in alignment are swiveled by the hydraulic swivel motor 38 of the hydraulic actuator 18 to orient the booms 19, 21 in parallel with the lengthwise direction of the ship, i.e., along the direction of travel of the carriages 11a as seen in FIG. 5. With the pawls 31a of the two guide arms 31 opened, the slider 16 is moved by the slider moving winches 17 to align the booms 19, 21 with the canistered missile M. The boom 19 is raised as held horizontal to its upper limit position by the hydraulic cylinder 36 of the hydraulic actuator 18.

Figure 4:
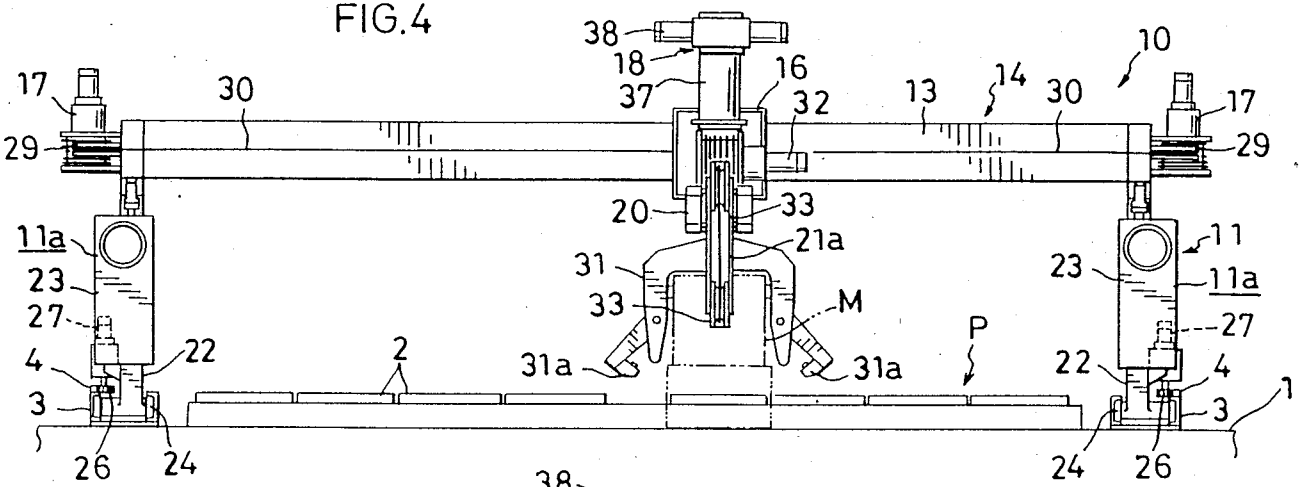
FIG. 4 is a front view showing the apparatus with a canistered missile thereby held during use.
Figure 11:
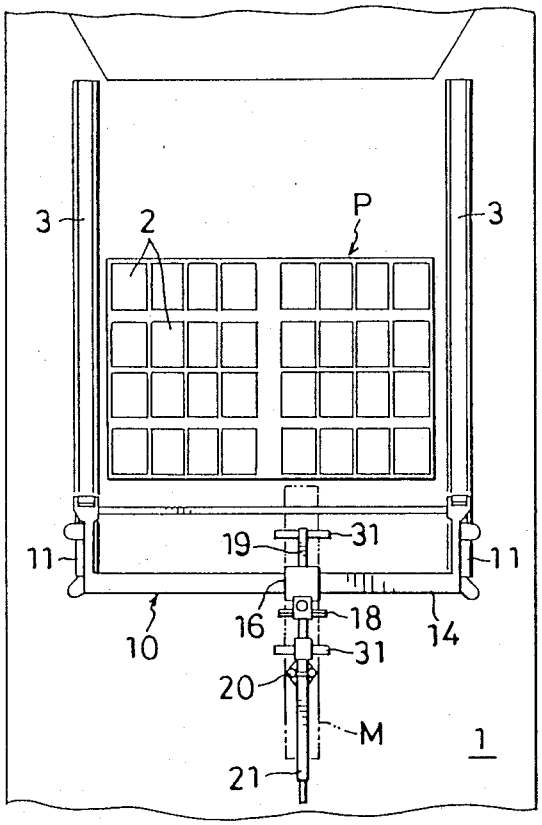
FIGS. 10 to 12 show the apparatus when the apparatus as held out of use is operated to insert the canistered missile into the stowage.

Next, with reference to FIGS. 4, 5 and 11, the apparatus 10 is advanced to position the first boom 19 immediately above the canistered missile M. Before this procedure, the vertical pulley holder 21a is brought to an inclined position indicated in broken line in FIG. 5 by driving the suspending winch 32 to avoid the contact of the pulley holder 21a with the canistered missile M. The boom 19 is lowered by the hydraulic cylinder 36 of the hydraulic actuator 18, and the pawls 31*a* of the two guide arms 31 are thereafter closed, causing the guide arms 31 to hold the missile M. The foward end of the wire 34 of the suspending winch 32 is removed from the wire retainer 35 and attached to the end of the adaptor 39. The boom 19 as held horizontal is raised to its upper limit position again by the hydraulic cylinder 36 of the hydraulic actuator 18.

Now with reference to FIGS. 6 to 9 and FIG. 12, the apparatus 10 is retracted to move the canistered missile M to a position where the missile M can be inserted to the specified cell of the stowage P. The piston rods of the hydraulic cylinders 15 are advanced to pivotally move the upper structure 14 to the boom raised position to position the boom 19 vertically.

The door 2 of the stowage cell is opened, and the canistered missile M is positioned immediately above the cell. The canistered missile M is lowered by the suspending winch 32 and thereby inserted into the cell while being guided by the cell guide provided at the opening of the cell.

Although the canistered missile is handled as an elongated heavy article by the embodiment described above, the article is not limited to the missile.

What is claimed is:

1. An apparatus for use on a ship for inserting a multiplicity of elongated heavy articles into a stowage, the stowage being provided in the hull of the ship and including a multiplicity of cells in a latticework arrangement and each having an opening in a deck for stowing the respective articles, the apparatus comprising a lower structure having a pair of opposed carriages guidable respectively on a pair of rails extending parallel to each other and disposed on the deck outwardly of the respective opposite sides of the stowage, an upper structure supported by the lower structure pivotally movably upward and downward and having a horizontal beam extending transversely of the ship and a slider slidably mounted on the horizontal beam, a boom connected to the slider and having a pair of guide arms for guiding and holding the article, the boom being positionable horizontally along the direction of travel of the carriages and also vertically by the pivotal movement of the upper structure, and lift means provided on the boom for suspending the article.

2. An apparatus as defined in claim 1 wherein each of the elongated heavy articles is a canistered missile.

3. An apparatus as defined in claim 1 wherein each of the rails comprises a pair of channels spaced apart transversely of the ship with their inner sides opposed to each other, and a rack is secured to one of the channels and extends over the entire length thereof, each of the carriages comprising a carriage frame L-shaped when seen from one side, an electric-hydraulic power unit fixedly mounted on the lower horizontal portion of the frame, a pair of front wheels and a pair of rear wheels rollable on the lower horizontal portions of the pair of channels of the rail, and drive means for rotating a pinion meshing with the rack to drive the carriage.

4. An apparatus as defined in claim 1 wherein each of the carriages comprises a carriage frame L-shaped when seen from one side, and the horizontal beam extends between and is secured to the front ends of a pair of opposed support arms each pivoted at its rear end to the upper end of the carriage frame by a transverse horizontal pin, a hydraulic cylinder being pivoted at its base end approximate to the inner corner portion of the carriage frame and having its piston rod pivoted at the forward end thereof to the support arm at a portion thereof close to its rear end.

5. An apparatus as defined in claim 1 wherein the horizontal beam extends between and is secured to the front ends of a pair of opposed support arms, each pivoted at its rear end to the upper portion of the carriage by a transverse horizontal pin, each of the support arms being provided with a slider moving winch outwardly of its rear end and a pulley on the outer side of its front end, and a wire extending from the winch on each support arm reeved around the pulley on the support arm and secured to the corresponding one of opposite sides of the slider.

6. An apparatus as defined in claim 1 wherein the boom comprises a first boom member and a second boom member connected thereto by a hinge pin joint, the first boom member being connected to the slider by a hydraulic actuator swivelably in a horizontal plane, the boom being foldable in two to make the first and second boom members coextensive along a direction perpendicular to the direction of travel of the carriages when not in use, the two boom members being positionable in alignment with each other to extend along the direction of travel of the carriages.

7. An apparatus as defined in claim 6 wherein the pair of guide arms are inverted U-shaped and attached to the respective ends of the first boom member to hold the article and also serve as guides for preventing the article from swinging when the article is to be inserted into the specified one of the stowage cell, each of the guide arms having openable pawls at their respective ends, the first boom member having an article suspending winch mounted on a lengthwise intermediate portion thereof, the second boom member carrying a pulley holder pivoted to its forward end by a horizontal pin and having a pair of upper and lower pulleys, a wire extending from the suspending winch and being reeved around the pulleys, the wire having its forward end removably attached to a wire retainer provided on the second boom member.

8. An apparatus as defined in claim 6 wherein the hydraulic actuator comprises a hydraulic cylinder attached to the front side of the slider as oriented downward and having a hollow rod, a rotary shaft rotatably inserted through the hollow rod and secured at its forward end to the first boom member, and a hydraulic swivel motor having an output shaft connected to the rotary shaft by a slide coupling, the first boom being swivelable about the rotary shaft by the hydraulic swivel motor of the hydraulic actuator and movable by the hydraulic cylinder of the actuator in the direction of advance or retraction of the rod thereof.

* * * * *